United States Patent [19]

Gubau

[11] Patent Number: 4,623,273

[45] Date of Patent: Nov. 18, 1986

[54] CARTRIDGE FOR A RIBBON FOR TYPEWRITERS

[75] Inventor: Josè Gubau, Spagnola, Italy

[73] Assignee: Ing. C. Olivetti & C., S.p.A., Turin, Italy

[21] Appl. No.: 599,796

[22] Filed: Apr. 13, 1984

[30] Foreign Application Priority Data

Apr. 13, 1983 [IT] Italy ..... 53197/83[U]

[51] Int. Cl.[4] ..... B41J 32/00

[52] U.S. Cl. ..... 400/208; 400/234; 400/235.1; 400/228

[58] Field of Search ..... 400/194, 195, 196, 196.1, 400/207, 208, 208.1, 228, 229, 234, 235.1, 243

[56] References Cited

U.S. PATENT DOCUMENTS

| | | | |
|---|---|---|---|
| 3,520,495 | 7/1970 | Sotani | 400/208 X |
| 3,528,626 | 9/1970 | Bumb, Jr. | 400/208 X |
| 4,010,839 | 3/1977 | Guerrini et al. | 400/207 |
| 4,299,504 | 11/1981 | Benz et al. | 400/196 X |
| 4,317,636 | 3/1982 | Hume | 400/196 X |
| 4,396,305 | 8/1983 | Shattuck et al. | 400/208 |
| 4,425,046 | 1/1984 | Van Horne et al. | 400/229 X |
| 4,502,801 | 3/1985 | Hefti et al. | 400/208 |
| 4,538,931 | 9/1985 | Nagashima | 400/208 X |

FOREIGN PATENT DOCUMENTS

| | | | |
|---|---|---|---|
| 0048418 | 3/1982 | European Pat. Off. | 400/208 |
| 0090164 | 10/1983 | European Pat. Off. | 400/208 |

*Primary Examiner*—Ernest T. Wright, Jr.

*Attorney, Agent, or Firm*—Banner, Birch, McKie, & Beckett

[57] ABSTRACT

The cartridge comprises a container (7) of substantially parallelepipedal form with its corners radiused and rounded off. The container is provided with a back (8) having a slot (27) adapted to guide a slide (26) on the ends of which are rotatably mounted a feed spool (22) and a take-up spool (32) on which the ribbon (21) is wound. A spring (36) engaged with a stud (41) on the slide keeps the slide (26) towards the right-hand side of the container with the take-up spool (32) engaged with the pin teeth of a feed roller (42). As the turns of ribbon wound on the take-up spool increase, the slide shifts with the two spools towards the left-hand side of the container in opposition to the action of the spring. The cartridge is mounted removably on a support of the machine which is inclined with respect to the horizontal plane of the machine passing through the printing point in a manner such as to permit visibility of the printed characters.

3 Claims, 3 Drawing Figures

CARTRIDGE FOR A RIBBON FOR TYPEWRITERS

The present invention relates to a cartridge for a printing ribbon for typewriters, in particular for portable typewriters.

A cartridge is known comprising a container having a feed spool rotatable in the container, a support on which a take-up spool is pivoted, and a spring adapted to keep the support rotated with the take-up spool engaged with the teeth of a feed or advancing roller. This cartridge is reliable, but, as its over-all dimensions must accommodate the feed and take-up spools, they lend themselves little to a portable typewriter.

The object of the present invention is to provide a cartridge whose over-all dimensions are reduced and which at the same time is simple, reliable and of relatively low cost.

The cartridge according to the invention is defined in claim 1 below.

A preferred embodiment of the cartridge is represented in the following description given by way of example, with reference to the accompanying drawings, in which.

Figure 1:
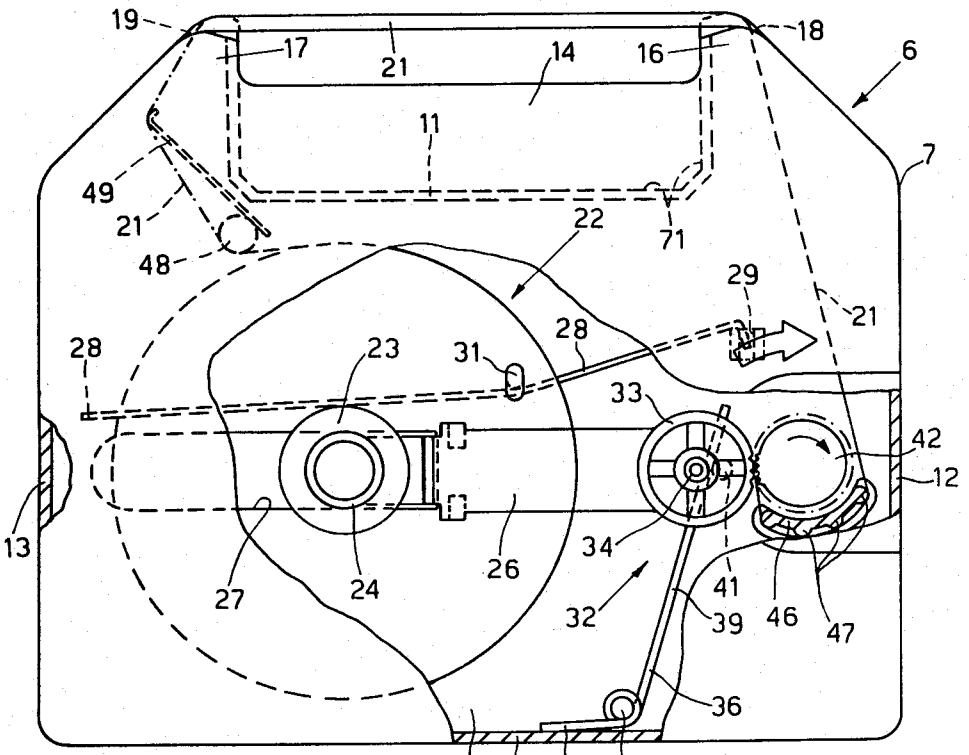
FIG. 1 is a partial plan view of the cartridge.

Referring to FIG. 1, the removable printing ribbon cartridge 6 comprises a container 7 having a substantially parallelepipedal shape with its corners radiused and rounded off. The container 7 comprises a back 8, a front wall 9, a rear wall 11, two side walls, being a right-hand wall 12 and a left-hand wall 13, and a cover 14 which closes the container 7 at the top.

The cartridge 6 has two arms 16 and 17 projecting from the rear wall 11, each having an aperture 18, 19 adapted to permit the passage of an inked or carbon ribbon 21. The cartridge 6 comprises a feed spool 22 on which the ribbon 21 is wound. The feed spool 22 comprises a core 23 rotatable about a collar 24 projecting from a slide 26 housed and slidable in a guide or slot 27 in the back 8 of the container 7. A wire spring 28 supported at one end in a bearing 29 projecting from the back 8 is adapted to cooperate with the lower part of the core 23 to prevent casual rotation of the feed spool 22, and therefore, the unwinding of the ribbon 21. Since the wire spring 28 bears against a shoulder 31 projecting from the back 8, it is normally preloaded by the shoulder 31, as a result of which it also exerts a frictional action during the normal unwinding of the feed spool 22.

Figure 2:
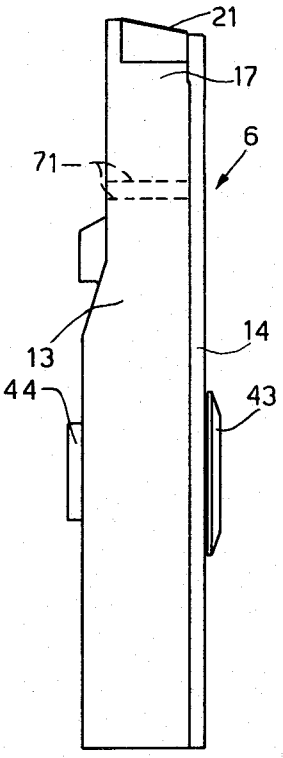
FIG. 2 is a partial side view of the cartridge of FIG. 1.
Figure 3:
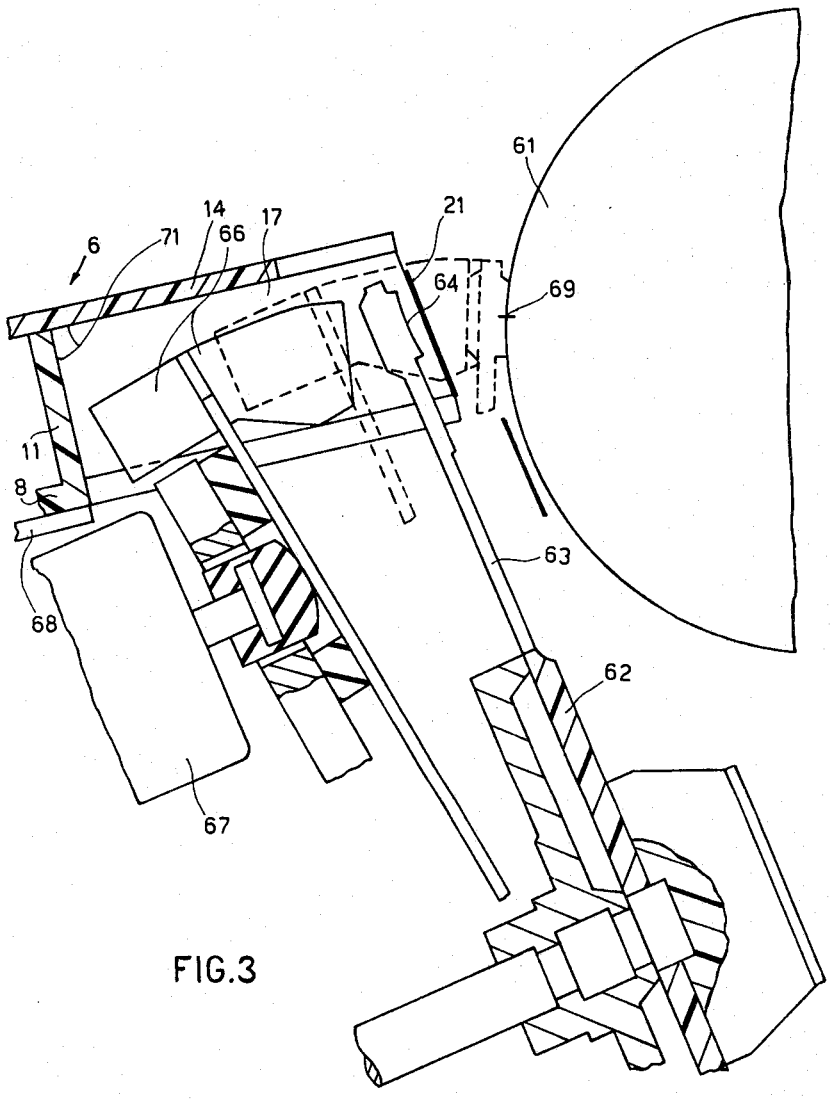
FIG. 3 is a partial side view on a different scale of the cartridge of FIG. 1 mounted on a typewriter.

The cartridge 6 comprises a take-up spool 32 on to which the ribbon 21 winds after it has been used at the printing point between the arms 16 and 17. The take-up spool 32 is constituted by a core 33 which is rotatable about a collar 34 projecting from the slide 26. A wire spring 36 seated on a stud 37 projecting from the back 8 has one end 38 engaged against the front wall 9 and the other end 39 engaged against a stud or pin 41 on the slide 26, whereby it normally biases the slide 26 towards the right-hand side wall 12 and therefore keeps the take-up spool 32 bearing with the outer surface of the ribbon 21 against a series of pin teeth of a feed or advancing roller 42 supported rotatably by the cartridge 6. At the top, the feed roller 42 comprises a disc 43 (FIG. 2) for manual actuation of the roller 42. At the bottom, the roller 42 is moreover engageable through the medium of a sleeve or collar 44 seated in and projecting from the back 8 of the container 7 by a driving shaft 66 shown in FIG. 3 of Guerrini et al U.S. Pat. No. 4,010,839.

Finally, from the back 8 (FIG. 1) of the container 7 there project guide means 46 having the form of a cylindrical sector comprising semi-cylindrical ribs 47 adapted to convey the ribbon 21 from the aperture 18 into the proximity of the feed roller 42 and therefore towards the take-up spool 32.

The ribbon 21, unwinding from the feed spool 22, bears on a fixed pin 48 projecting from the back 8 of the container 7 and then bears on the end of a leaf spring 49 with a buffer function for controlling the unwinding of the ribbon 21 towards the aperture 19, issues from the aperture 19, re-enters at the aperture 18, bears against the ribs 47 outside the path of the teeth of the feed roller 42 and is wound on the take-up spool 32.

Under the action of the spring 36, the feed roller 42 engages with its teeth the outermost turns of the ribbon 21 wound on the take-up spool 32 in the proximity of the median portion of the ribbon 21. The rotation of the roller 42 causes the take-up spool 32 to rotate and causes the ribbon 21 to be wound on the core 33 by equal incremental steps in a manner known per se. The presence of a single row of teeth on the roller 42 ensures that the ribbon 21 is pulled uniformly and parallel to the axis of the take-up spool 32.

When the cartridge 6 is fresh, the ribbon 21 is wholly wound on the feed spool 22 and only a few turns of ribbon 21 are wound on the take-up spool 32. As the ribbon 21 is used, however, the number of turns wound on the feed spool 22 decreases, while the number of turns wound on the take-up spool 32 increases. For this reason, as the number of turns increases on the take-up spool 32, the diameter of the take-up spool 32 also changes and, therefore, the take-up spool 32 slides with the slide 26 in the slot 27 together with the feed spool 22, shifting towards the left-hand side wall 13 in opposition to the action of the spring 36 until the ribbon 21 is fully wound on the take-up spool 32. As a result, the cartridge 6 is used up and is replaced by a fresh cartridge 6.

The cartridge 6 hereinbefore described is mounted on a typewriter comprising a conventional paper platen 61 (FIG. 3), a conventional type wheel (daisywheel) 62 having a series of flexible spokes 63 each bearing a type 64 at its end, and a striking hammer 66 actuated by an electromagnet 67. The cartridge 6 is mounted removably on a fixed support 68 of the machine in a manner known per se and not shown in the drawings. The support 68 is inclined with respect to the horizontal plane of the machine passing through a printing point 69 in a manner such as to permit the operator, with the cartridge 6 mounted inclined and parallel to the support 68, visibility of the characters printed in correspondence with the printing point 69.

Finally, the cartridge 6 comprises a space 71 defined laterally by the arms 16 and 17 (FIG. 1), at the front by the printing ribbon 21 extending from the arms 16 and 17, at the rear by the rear wall 11 and at the top by the cover 14. As is clearly visible from FIG. 3, the space 71 is adapted to accommodate the striking hammer 66 and the upper part of the daisy wheel 62 with the types 64. Moreover, the arms 16 and 17 of the cartridge 6 are shaped at the ends in such manner as to keep the portion of ribbon 21 extending from the arms 16, 17 themselves normally inclined so that, when the cartridge 6 is mounted on the support 68, the ribbon 21 ends up parallel to the types 64 on the spokes 63 of the daisy wheel 62, as is clearly apparent from FIG. 3.

I claim:

1. A printing ribbon cartridge for a printing machine comprising a container of substantially parallelepipedal form having a back, a front wall, a rear wall, a right side wall, a left side wall, and a cover, and two arms projecting from the rear wall, wherein each arm has an aperture for the passage of a portion of printing ribbon outside the container, wherein a feed spool having a core, a take-up spool and a feed roller having a series of pin teeth are supported rotatably in the container, and wherein another portion of printing ribbon winds on the feed spool and the take-up spool, wherein the back of said container has a guide slot substantially parallel to the rear wall and a bearing support, a shoulder and a stud all projecting toward said cover internally to the container, wherein a single support is housed and slidable in said guide support and comprises a first collar about which is rotatable said feed spool, a second collar about which is rotatable said take-up spool and a fixed pin, and wherein said first and second collars and said pin project from the single support toward said cover internally to the container and are disposed at the ends of the single support and wherein said fixed pin is disposed adjacent to said second collar, further comprising spring means having a buffer function for controlling the unwinding of the printing ribbon from the feed spool towards the aperture of one of said two arms, guide means having a form of cylindrical sector to convey the printing ribbon from the aperture of another of said two arms to said feed roller and to the take-up spool and wherein said cylindrical sector comprises semi-cylindrical ribs for reducing the surfaces of contact with the printing ribbon, a first wire spring supported at one end in the support bearing and bearing against said shoulder to have a portion disposed substantially parallel and along said guide slot and a second wire spring seated on the stud having one end bearing against the front wall and another end bearing against the fixed pin of said single support, wherein said shoulder preloads said first wire spring for cooperating with the core of the feed spool to prevent casual rotation of the feed spool and therefore the unwinding of the printing ribbon and simultaneously exerts a friction action during the normal unwinding of the feed spool, and wherein said second wire spring biases the single support towards the right side wall and keeps the take-up spool bearing with the outer surface of the printing ribbon against the series of pin teeth of the feed roller.

2. A printing ribbon cartridge according to claim 1, wherein the printing ribbon unwinds from the feed spool, issues from the aperture of the one of said two arms, re-enters at the aperture of the other of said two arms, bears against the semi-cylindrical ribs and is wound on the take-up spool, wherein the rotation of the feed roller causes the take-up spool to rotate, wherein the number of turns wound on the feed spool decreases while the number of turns wound on the take-up spool increases, the diameter of the take-up spool changes and the take-up spool slides with the single support in the guide slot together with the feed spool in opposition to the action of the second wire spring while the first wire spring frictions the core of the feed spool.

3. A printing ribbon cartridge according to claim 1, wherein the printing machine comprises a platen which defines a printing point, a printing element having a series of flexible laminae each bearing a character, an electromagnet, a striking hammer actuated by the electromagnet, and a fixed support disposed inclined with respect to the horizontal plane passing through the printing point and on which is removably mounted the back of said container parallel to said fixed support, wherein the cartridge comprises a space defined laterally by said arms, at the front by said portion of printing ribbon outside the container, at the rear by said rear wall and at the top by said cover, wherein said space accommodates the characters of the flexible laminae and the striking hammer of the printing machine and further enables the visibility of the characters printed in correspondence with said printing point without any movement of the cartridge.

* * * * *